US010407750B2

(12) United States Patent
Oliver et al.

(10) Patent No.: US 10,407,750 B2
(45) Date of Patent: Sep. 10, 2019

(54) METHOD FOR PRODUCING HIGH-STRENGTH DUPLEX STAINLESS STEEL

(71) Applicant: Outokumpu Oyj, Espoo (FI)

(72) Inventors: James Oliver, Fjärdhundra (SE); Jan-Olof Andersson, Krylbo (SE); Erik Schedin, Uppsala (SE)

(73) Assignee: OUTOKUMPU OYJ, Helsinki (FI)

( * ) Notice: Subject to any disclaimer, the term of this patent is extended or adjusted under 35 U.S.C. 154(b) by 286 days.

(21) Appl. No.: 15/103,357

(22) PCT Filed: Dec. 10, 2014

(86) PCT No.: PCT/FI2014/050978
§ 371 (c)(1),
(2) Date: Jun. 10, 2016

(87) PCT Pub. No.: WO2015/086903
PCT Pub. Date: Jun. 18, 2015

(65) Prior Publication Data

US 2016/0319391 A1 Nov. 3, 2016

(30) Foreign Application Priority Data

Dec. 13, 2013 (FI) ..... 20136257
Jun. 17, 2014 (FI) ..... 20145573

(51) Int. Cl.

| | |
|---|---|
| ***C21D 9/48*** | (2006.01) |
| ***C21D 7/10*** | (2006.01) |
| ***C22C 38/58*** | (2006.01) |
| ***C22C 38/54*** | (2006.01) |
| ***C22C 38/52*** | (2006.01) |
| ***C22C 38/00*** | (2006.01) |
| ***C22C 38/48*** | (2006.01) |
| ***C22C 38/46*** | (2006.01) |
| ***C22C 38/44*** | (2006.01) |
| ***C22C 38/42*** | (2006.01) |
| ***C22C 38/06*** | (2006.01) |
| ***C22C 38/02*** | (2006.01) |
| ***C21D 8/04*** | (2006.01) |
| ***C22C 38/50*** | (2006.01) |
| ***C21D 6/02*** | (2006.01) |
| ***C21D 1/26*** | (2006.01) |
| ***C22C 38/40*** | (2006.01) |

(Continued)

(52) U.S. Cl.
CPC ..... *C21D 9/48* (2013.01); *C21D 1/26* (2013.01); *C21D 6/02* (2013.01); *C21D 7/10* (2013.01); *C21D 8/0405* (2013.01); *C21D 8/0436* (2013.01); *C21D 8/0442* (2013.01); *C22C 38/001* (2013.01); *C22C 38/002* (2013.01); *C22C 38/02* (2013.01); *C22C 38/06* (2013.01); *C22C 38/40* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/58* (2013.01); *C21D 7/02* (2013.01); *C21D 8/02* (2013.01); *C21D 2211/001* (2013.01); *C21D 2211/005* (2013.01)

(58) Field of Classification Search
CPC ..... C21D 1/26; C21D 2211/001; C21D 2211/005; C21D 6/02; C21D 7/02; C21D 7/10; C21D 8/02; C21D 8/0405; C21D 8/0436; C21D 8/0442; C21D 9/48; C22C 38/001; C22C 38/002; C22C 38/02; C22C 38/06; C22C 38/40; C22C 38/42; C22C 38/44; C22C 38/46; C22C 38/48; C22C 38/50; C22C 38/52; C22C 38/54; C22C 38/58
See application file for complete search history.

(56) References Cited

U.S. PATENT DOCUMENTS 3,258,370 A * 6/1966 Floreen ..... C22C 38/40 148/506
6,282,933 B1 9/2001 Dupoiron
(Continued)

FOREIGN PATENT DOCUMENTS

CN 102605284 A 7/2012
EP 436032 A1 7/1991
(Continued)

OTHER PUBLICATIONS

J. W. Morris, S. J. Hardy and J. T. Thomas Effects of tension levelling process parameters on cold rolled strip characteristics using a designed factorial analysis approach Ironmaking and Steelmaking, vol. 32 No. 5, pp. 443-448 (Year: 2005).*
(Continued)

*Primary Examiner* — Jenny R Wu
(74) *Attorney, Agent, or Firm* — Robert P. Michal, Esq.; Carter, DeLuca & Farrell LLP

(57) ABSTRACT

The invention relates to a method for producing a high-strength ferritic austenitic duplex stainless steel with the TRIP (Transformation induced plasticity) effect with deformation. After the heat treatment on the temperature range of 950-1150° C. in order to have high tensile strength level of at least 1000 MPa with retained formability the ferritic austenitic duplex stainless steel is deformed with a reduction degree of at least 10%, preferably at least 20% so that with a reduction degree of 20% the elongation ($A_{50}$) is at least 15%.

8 Claims, 2 Drawing Sheets

(51) Int. Cl.
*C21D 7/02* (2006.01)
*C21D 8/02* (2006.01)

(56) References Cited

U.S. PATENT DOCUMENTS

| | | | | |
|---|---|---|---|---|
| 6,423,160 | B1 * | 7/2002 | Arimoto | C21D 8/0205 148/325 |
| 6,893,727 | B2 | 5/2005 | Adachi et al. | |
| 2010/0294402 | A1 * | 11/2010 | Hamada | C21D 6/002 148/611 |

FOREIGN PATENT DOCUMENTS

| | | | |
|---|---|---|---|
| GB | 2481175 | A | 12/2011 |
| WO | 2012143610 | A1 | 10/2012 |
| WO | 2013034804 | A1 | 3/2013 |

OTHER PUBLICATIONS

International Search Report prepared by the Finnish Patent and Registration Office for PCT/FI2014/050978, dated Feb. 25, 2015, 4 pages.
Written Opinion prepared by the Finnish Patent and Registration Office for PCT/FI2014/050978, dated Feb. 25, 2015, 6 pages.

* cited by examiner

METHOD FOR PRODUCING HIGH-STRENGTH DUPLEX STAINLESS STEEL

CROSS-REFERENCE TO RELATED APPLICATIONS

This is a national stage application filed under 35 USC 371 based on International Application No. PCT/FI2014/050978 filed Dec. 10, 2014 and claims priority under 35 USC 119 of Finnish Patent Application No. 20136257 filed Dec. 13, 2013 and Finnish Patent Application No. 20145573 filed Jun. 17, 2014.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

The invention relates to a method for producing high-strength ferritic austenitic duplex stainless steel with the attained TRIP (Transformation induced plasticity) effect by deforming in such a manner, that the retained formability at high strength level can be utilized in the ferritic austenitic duplex stainless steel.

BACKGROUND OF THE INVENTION

Deforming is a technique used to increase the strength of a material through a precision cold reduction targeting a specific proof strength or tensile strength. The surface finishes for deformed stainless steels for instance by temper rolling are denoted according to the standard EN 10088-2 as 2H and according to the standard ASTM A666-03 as TR.

The standard austenitic stainless steels such as 301/EN 1.4310, 304/EN 1.4301 and 316L/EN 1.4404 are used in temper rolled condition performed for the purpose of strength adjustment. Thanks to work hardening a high strength is obtained. Further, due to hardening caused by strain induced martensitic transformation in deformed portions, the so-called TRIP (Transformation induced plasticity) effect, the steels 301 and 304 have excellent workability. However, a decrease in workability accompanying an increase in strength is unavoidable. This behaviour is applied in the U.S. Pat. No. 6,893,727 for a metal gasket manufacturing of an austenitic stainless steel containing in weight % at most 0.03% C, at most 1.0% Si, at most 2.0% Mn, 16.0-18.0% Cr, 6-8% Ni, at most 0.25% N, optionally at most 0.3% Nb, the rest being iron and inevitable impurities. The microstructure is advantageously either a dual phase structure having at least 40% martensite and the rest of austenite or a single phase structure of martensite.

The U.S. Pat. No. 6,282,933 relates to a method of manufacturing a metal carcass for use in a flexible tube or umbilical. The method contains a work-hardening step for the metal strip before shaping and before winding the strip to form a carcass. According to this patent all the metals which after work-hardening have a yield strength higher than 500 MPa and an elongation at rupture of at least 15% can be used to manufacture a metal carcass. However, this U.S. Pat. No. 6,282,933 also describes that it was already known that duplex and superduplex materials, used for the manufacture of metal carcasses, do not need to be work-hardened since they fulfill the above mentioned demands without work hardening. The work-hardening according to this U.S. Pat. No. 6,282,933 is done for austenitic stainless steels, for instance 301, 301 LN, 304L and 316L, in order to make possible to use these materials for the manufacture of metal carcasses.

The EP patent application 436032 relates to a method of producing high-strength stainless steel strip having a dual ferrite/martensite microstructure containing in weight % 0.01-0.15% carbon, 10-20% chromium and at least one of the elements nickel, manganese and copper in an amount of 0.1-4.0 for springs. For the dual ferrite/martensite microstructure the cold rolled strip is continuously passed through a continuous heat treatment furnace where the strip is heated to a temperature range for two-phase of ferrite and austenite and, thereafter the heated strip is rapidly cooled to provide a strip of a dual structure, consisting essentially of ferrite and martensite and, further, optionally temper rolling of the dual phase strip at a rolling degree of not more than 10%, and still a step of continuous aging of no longer than 10 min in which the strip of the dual phase is continuously passed through a continuous heat treatment furnace. Because the object of this EP 436032 is to manufacture a spring material, the spring value can be improved with temper rolling before aging.

The GB patent application 2481175 relates to a process for manufacturing a flexible tubular pipe using wires of austenitic ferritic stainless steel containing 21-25 weight % chromium, 1.5-7 weight % nickel and 0.1-0.3 weight % nitrogen. In the process after annealing at the temperature range of 1000-1300° C. and cooling, the wires are work-hardened by reducing the cross-section at least 35% so that the work-hardened wires have a tensile strength greater than 1300 MPa. Further, the work-hardened wires are wound up directly after the work-hardening step retaining their mechanical properties.

The object of the present patent application is to eliminate some drawbacks of the prior art and to achieve an improved method for producing high-strength ferritic austenitic duplex stainless steel with the attained TRIP (Transformation induced plasticity) effect by deforming in such a manner, that the retained formability at high strength level can be utilized in the ferritic austenitic duplex stainless steel.

In the method according to the present invention a ferritic austenitic duplex stainless steel with the attained TRIP (Transformation induced plasticity) effect is first heat treated at the temperature range of 950-1150° C. After cooling, in order to have high tensile strength level of at least 1000 MPa with retained formability the ferritic austenitic duplex stainless steel is deformed with a reduction degree of at least 10%, preferably at least 20%, having the elongation ($A_{50}$) at least 15%. With the reduction degree of at least 40% the ferritic austenitic duplex stainless steel achieves the tensile strength level of at least 1300 MPa and has the elongation ($A_{50}$) at least 4.5%. After deformation the ferritic austenitic stainless steel is advantageously heated at the temperature range of 100-450° C., preferably at the temperature range of 175-250° C. for a period of 1 second-20 minutes, preferably 5-15 minutes, to improve the strength further whilst retaining an elongation ($A_{50}$) of at least 15%. In addition to the already well known high corrosion properties the deformed duplex stainless steel with the attained TRIP effect has improved strength to ductility ratio, the fatigue strength and the erosion resistance.

In one preferred embodiment (A) the duplex stainless steel with the TRIP effect in accordance with the invention contains in weight % less than 0.05% carbon (C), 0.2-0.7% silicon (Si), 2-5% manganese (Mn), 19-20.5% chromium (Cr), 0.8-1.5% nickel (Ni), less than 0.6% molybdenum (Mo), less than 1% copper (Cu), 0.16-0.26% nitrogen (N), the sum C+N being 0.2-0.29%, less than 0.010 weight %, preferably less than 0.005 weight % S, less than 0.040 weight % P so that the sum (S+P) is less than 0.04 weight %, and the total oxygen (O) below 100 ppm, optionally contains one or more added elements; 0-0.5% tungsten (W), 0-0.2% niobium (Nb), 0-0.1% titanium (Ti), 0-0.2% vanadium (V), 0-0.5% cobalt (Co), 0-50 ppm boron (B), and 0-0.04% aluminium (Al), the balance being iron (Fe) and inevitable impurities occurring in stainless steels. This duplex stainless steel is known from the WO patent application 2012/143610.

The duplex stainless steel of the embodiment (A) has the yield strength $R_{p0,2}$ 450-550 MPa, the yield strength $R_{p1,0}$ 500-600 MPa and the tensile strength $R_m$ 750-850 MPa after the heat treatment on the temperature range of 1000-1100° C.

In another preferred embodiment (B) the duplex stainless steel with the TRIP effect in accordance with the invention contains in weight % less than 0.04 carbon (C), less than 0.7% silicon (Si), less than 2.5 weight % manganese (Mn), 18.5-22.5% chromium (Cr), 0.8-4.5% nickel (Ni), 0.6-1.4% molybdenum (Mo), less than 1% copper (Cu), 0.10-0.24% nitrogen (N), optionally one or more added elements: less than 0.04% aluminium (Al), preferably less than 0.03% aluminium (Al), less than 0.003% boron (B), less than 0.003% calcium (Ca), less than 0.1% cerium (Ce), up to 1% cobalt (Co), up to 0.5% tungsten (W), up to 0.1% niobium (Nb), up to 0.1% titanium (Ti), up to 0.2% vanadium (V), the rest being iron (Fe) and inevitable impurities occurring in stainless steels. This duplex stainless steel is known from the WO patent application 2013/034804.

The duplex stainless steel of the embodiment (B) has the yield strength $R_{p0,2}$ 500-550 MPa, the yield strength $R_{p1,0}$ 550-600 MPa and the tensile strength $R_m$ 750-800 MPa after the heat treatment on the temperature range of 950-1150° C.

The deforming of the ferritic austenitic duplex stainless steel according to the invention can be carried out by cold forming such as temper rolling, tension levelling, roller levelling, drawing or any other method which can be used for a desired reduction in a dimension or in dimensions of the object made of the ferritic austenitic duplex stainless steel.

BRIEF SUMMARY OF THE INVENTION

Not applicable.

BRIEF DESCRIPTION OF THE SEVERAL VIEWS OF THE DRAWINGS

The invention is described in more details referring to the following drawings wherein.

DETAILED DESCRIPTION OF THE INVENTION

Figure 1:
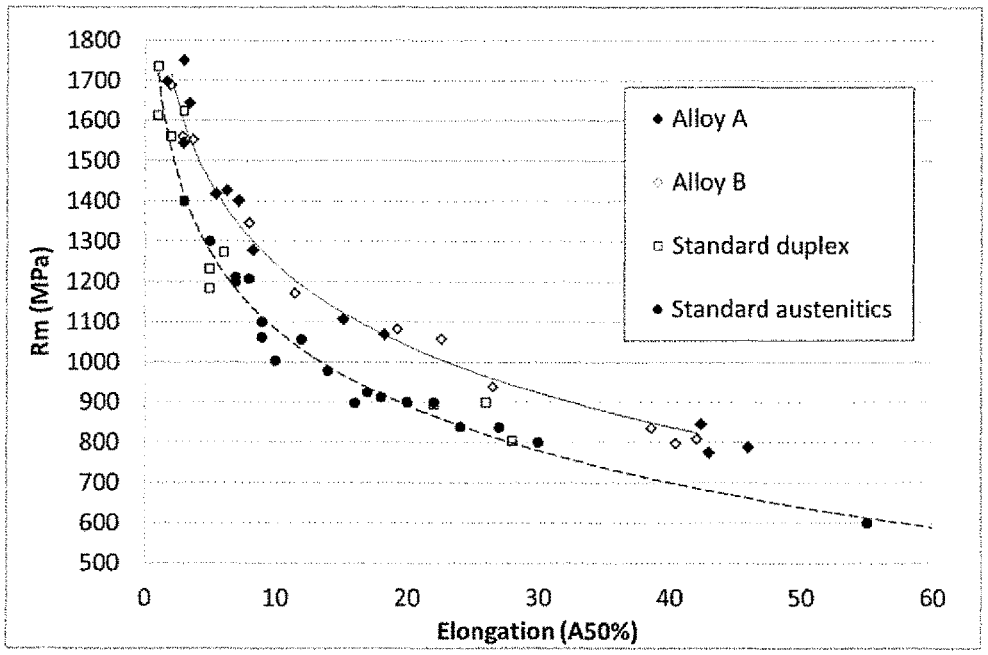
FIG. 1 illustrates the tensile strength ($R_m$) of the steels versus elongation ($A_{50}$) of the steels.

The duplex stainless steels according to the embodiments (A) and (B) of the invention after a heat treatment, solution annealing on the temperature range of 950-1150° C. were temper rolled in accordance with the invention with the reduction degree of at least 10%, preferably at least 20%. The yield strength $R_{p0,2}$ and the tensile strength $R_m$ values were determined for both duplex stainless steels (A) and (B) and the results are in the table 1. As the reference alloys the table 1 also contains the respective values for the ferritic austenitic duplex stainless steels LDX 2101, 2205 and 2507 as well as for the standard austenitic stainless steels 1.4307 (304L) and 1.4404 (316L).

TABLE 1

| Alloy | Thickness mm | Reduction % | $R_{p0.2}$ MPa | $R_m$ MPa | $A_{50}$ % |
|---|---|---|---|---|---|
| A | 3.36 | 0 | 599 | 788 | 46 |
| | 1.45 | 0 | 611 | 845 | 42.4 |
| | 0.4 | 0 | 521 | 774 | 43 |
| | 0.69 | 20 | 894 | 1068 | 18.3 |
| | 2.72 | 20 | 973 | 1107 | 15.2 |
| | 0.59 | 30 | 999 | 1278 | 8.3 |
| | 0.25 | 40 | 1096 | 1400 | 7.2 |
| | 0.51 | 40 | 1113 | 1426 | 6.3 |
| | 1.1 | 40 | 1165 | 1418 | 4.5 |
| | 1.72 | 50 | 1271 | 1544 | 2.6 |
| | 0.41 | 50 | 1284 | 1642 | 3.5 |
| | 1.45 | 60 | 1439 | 1697 | 1.7 |
| | 0.16 | 60 | 1305 | 1750 | 3 |
| B | 0.46 | 0 | 519 | 808 | 42.1 |
| | 2.06 | 0 | 580 | 797 | 40.5 |
| | 0.8 | 0 | 611 | 836 | 38.6 |
| | 1.65 | 10 | 918 | 1057 | 22.6 |
| | 0.88 | 10 | 826 | 937 | 26.5 |
| | 1.32 | 10 | 883 | 1035 | 23.4 |
| | 1.65 | 20 | 936 | 1082 | 19.2 |
| | 0.68 | 30 | 998 | 1171 | 10.6 |
| | 0.59 | 40 | 1056 | 1346 | 8 |
| | 1.2 | 40 | 1162 | 1403 | 7.2 |
| | 1 | 50 | 1298 | 1551 | 3.7 |
| | 0.47 | 50 | 1251 | 1560 | 2.9 |
| | 0.8 | 60 | 1468 | 1687 | 1.6 |
| LDX 2101 | 1 | 0 | 592 | 803 | 28 |
| | 0.8 | 20 | 976 | 1184 | 5 |
| | 0.6 | 40 | 1100 | 1400 | 3 |
| | 0.4 | 60 | 1216 | 1559 | 3 |
| 2205 | 0.7 | 0 | 698 | 894 | 22 |
| | 0.56 | 20 | 1080 | 1232 | 5 |
| | 0.42 | 40 | 1235 | 1400 | 3 |
| | 0.28 | 60 | 1331 | 1612 | 2 |
| | 0.203 | 71 | 1367 | 1692 | 2 |
| 2507 | 1 | 0 | 834 | 920 | 26 |
| | 0.8 | 20 | 1099 | 1273 | 6 |
| | 0.6 | 40 | 1362 | 1623 | 3 |
| | 0.4 | 60 | 1423 | 1736 | 2 |
| | 0.2 | 80 | 1548 | 1894 | 2 |
| 304L | | 0 | 270 | 600 | 55 |
| | | 14 | 648 | 800 | 30 |
| | | 17 | 719 | 839 | 24 |
| | | 17 | 710 | 837 | 27 |

TABLE 1-continued

| Alloy | Thickness mm | Reduction % | $R_{p0.2}$ MPa | $R_m$ MPa | $A_{50}$ % |
|---|---|---|---|---|---|
| | | 22 | 780 | 925 | 17 |
| | | 23 | 779 | 911 | 16 |
| | | 23 | 775 | 899 | 20 |
| | | 23 | 780 | 900 | 22 |
| | | 24 | 788 | 912 | 18 |
| | | 29 | 838 | 979 | 14 |
| | | 31 | 863 | 1005 | 10 |
| | | 35 | 910 | 1063 | 9 |
| | | 36 | 908 | 1057 | 12 |
| | | 37 | 1050 | 1100 | 9 |
| | | 48 | 1059 | 1208 | 8 |
| | | 48 | 1150 | 1200 | 7 |
| | | 50 | 1040 | 1211 | 7 |
| | | 58 | 1250 | 1300 | 5 |
| | | 72 | 1350 | 1400 | 3 |
| 316L | | 0 | 260 | 580 | 55 |
| | | 29 | 820 | 925 | 14 |
| | | 45 | 1000 | 1100 | 6 |
| | | 60 | 1050 | 1200 | 4 |
| | | 73 | 1150 | 1300 | 3 |
| | | 80 | 1250 | 1400 | 2 |

The results of the table 1 for the tensile strength $R_m$ versus the retained ductility (elongation $A_{50}$) are illustrated in FIG. 1 for the ferritic austenitic duplex stainless steels A and B of the invention and as the reference materials for the standard ferritic austenitic duplex steel (LDX 2101 and 2507) as well as for the standard austenitic stainless steel (304L).

The dashed line in FIG. 1 shows the trend for both standard duplex stainless steel and austenitic stainless steel grades, whereas the solid line is for the alloys A and B.

The results in FIG. 1 show that for a given tensile strength $R_m$ the retained ductility is substantially greater for the alloys A and B than for the standard duplex stainless steel and standard austenitic stainless steel grade 304L. Alternatively, for a given elongation $A_{50}$ the alloys A and B have up to 150 MPa greater tensile strength $R_m$ than the tensile strength $R_m$ for the standard duplex stainless steel and austenitic stainless steel grade 304L.

Figure 2:
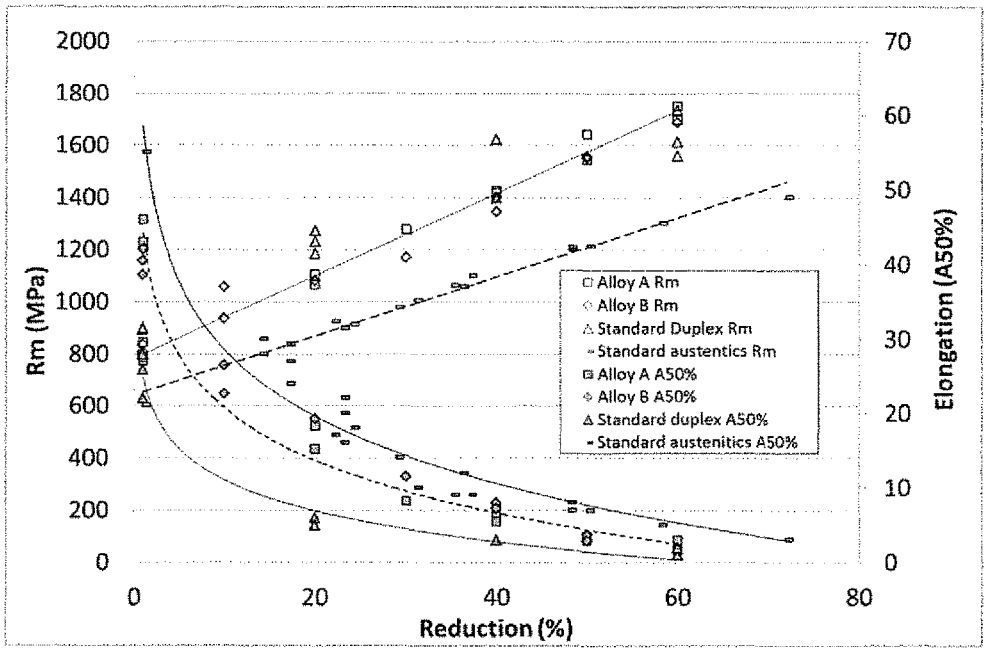
FIG. 2 illustrates the tensile strength ($R_m$) and the elongation ($A_{50}$) of the steels versus the cold rolling reduction by temper rolling of the steels.

FIG. 2 shows clearly the difference in retained ductility (elongation $A_{50}$) with respect to the cold rolling reduction when comparing the alloys A and B with the standard duplex stainless steel and austenitic stainless steel grade 304L. For instance, for a 20% cold rolling reduction of the standard duplex stainless steels only 5% of elongation $A_{50}$ is remaining, whereas the alloys A and B have 15-20% of elongation $A_{50}$ still remaining with the similar tensile strength $R_m$. Furthermore, the alloys A and B require a smaller cold rolling reduction degree than the standard austenitic stainless steel 304L to achieve the same target tensile strength $R_m$. Consequently, the retained ductility (elongation $A_{50}$) is greater in the alloys A and B than in the standard austenitic stainless steel 304L at the same tensile strength $R_m$.

The results in FIG. 2 also show that for instance in order to achieve a tensile strength $R_m$ of 1100-1200 MPa it is required a 20% temper rolling reduction degree for the standard duplex stainless steels and for the alloys A and B whereas a 50% temper rolling reduction degree is required for the austenitic stainless steel 304L in order to achieve the same tensile strength $R_m$ of 1100-1200 MPa. At the same time the alloys A and B have a greater retained ductility ($A_{50}$ 15-20%) compared to the standard duplex stainless steels ($A_{50}$ about 5%) and standard austenitic grade 304L ($A_{50}$ 7-8%).

For many applications where duplex stainless steels are used, the fatigue strength is important. Table 2 demonstrates the fatigue limit $R_{d50\ \%}$ of the steels before ($R_{d50\ \%}$(0%)) and after temper rolling ($R_{d50\ \%}$(TR %)) as well as the ratio $R_{d50\ \%}$(TR %)/$R_{d50\ \%}$(0%), i.e. the ratio of the fatigue limit between the temper rolled and the non-temper rolled material. The fatigue limit $R_{d50\ \%}$ describes 50% probability of failure after 2 million cycles, determined at stress maximum and R=0.1, where R is the ratio between maximum and minimum stress in the fatigue cycle.

TABLE 2

| Alloy | Reduction % | $R_{p0.2}$ MPa | $R_m$ MPa | $R_{d(50\%)}$ MPa | $R_{d50\%}$(TR %)/ $R_{d50\%}$(0%) |
|---|---|---|---|---|---|
| A | 0 | 594 | 799 | 596 | — |
| A | 30 | 1032 | 1235 | 719 | 1.21 |
| B | 0 | 580 | 797 | 594 | — |
| B | 10 | 918 | 1057 | 748 | 1.26 |

Table 2 demonstrates the fatigue limit itself and the value for the ratio $R_{d50\ \%}$(TR %)/$R_{d50\ \%}$(0%), the ratio being more than 1.2 for the temper rolled alloys A and B. The temper rolling according to the invention thus also improves the fatigue limit more than 20% for the alloys A and B.

Table 3 shows results for the erosion resistance of a range of stainless grades where for the mean volumetric wear rate was tested with the standardized test configuration GOST 23.208-79.

TABLE 3

| Alloy | Mean volumetric wear rate mm3/kg |
|---|---|
| 316L | 10.3 |
| 304L | 10.5 |
| 2507 | 9.3 |
| 2205 | 10.3 |
| LDX 2101 | 9.8 |
| Alloy B | 6.9 |
| Alloy A | 7.1 |
| Alloy A(TR) | 5.7 |

Figure 3:
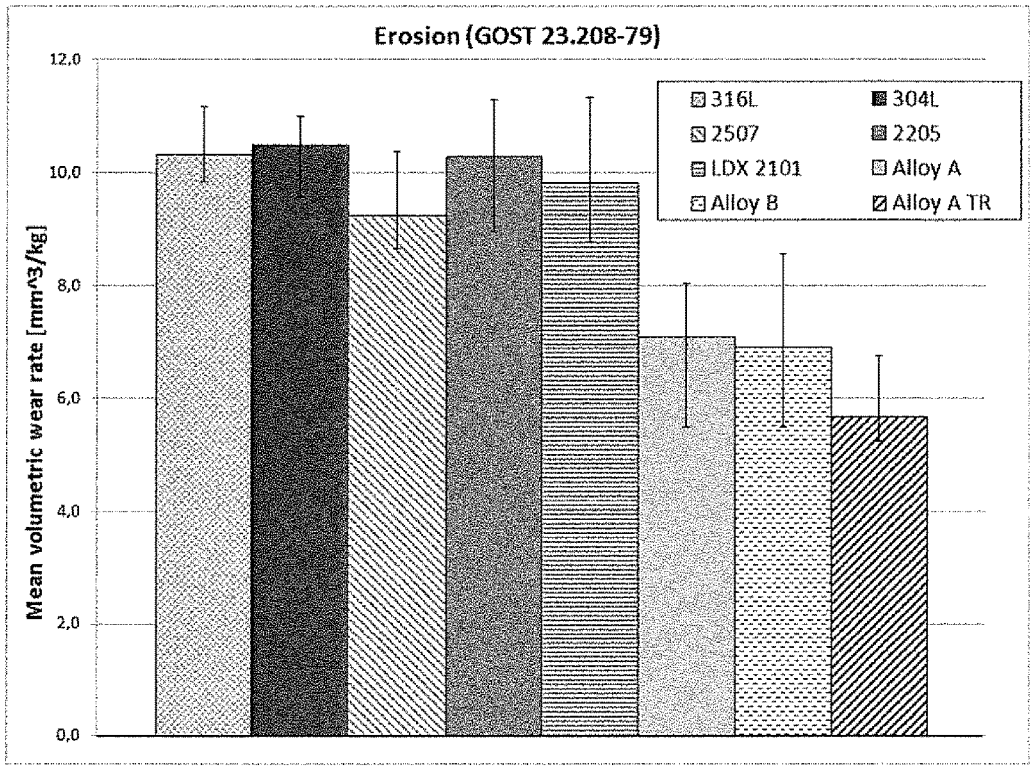
FIG. 3 illustrates the erosion resistance of the steels.

The results for the mean volumetric wear rate in Table 3 and in FIG. 3 demonstrate the high erosion resistance for the alloys A and B when comparing with the reference alloys of the austenitic stainless steel grades 316L and 304L as well as the duplex stainless steels 2507, 2205 and LDX 2101. The temper rolling according to the invention further improves the erosion resistance, as shown for the alloy A(TR), the alloy A after temper rolling in accordance with the invention. The mean volumetric wear rate after temper rolling is below 6.0 $mm^3$/kg.

The table 4 shows the favorable effect of the heat treatment to the yield strength ($R_{p0,2}$) and the elongation ($A_{50}$). The heat treatment is carried out after cold deformation.

TABLE 4

| Heat temperature (° C.) | $R_{p0.2}$ (MPa) | $R_m$ (MPa) | $A_{50}$ (%) |
|---|---|---|---|
| 25 | 883 | 1035 | 23.4 |
| 100 | 897 | 1026 | 23.2 |
| 150 | 906 | 1022 | 23.6 |
| 200 | 947 | 1032 | 21.7 |
| 250 | 961 | 1059 | 21.2 |
| 275 | 955 | 1062 | 21.0 |
| 300 | 950 | 1076 | 20.4 |
| 360 | 949 | 1075 | 18.2 |
| 420 | 951 | 1067 | 18.0 |

Figure 4:
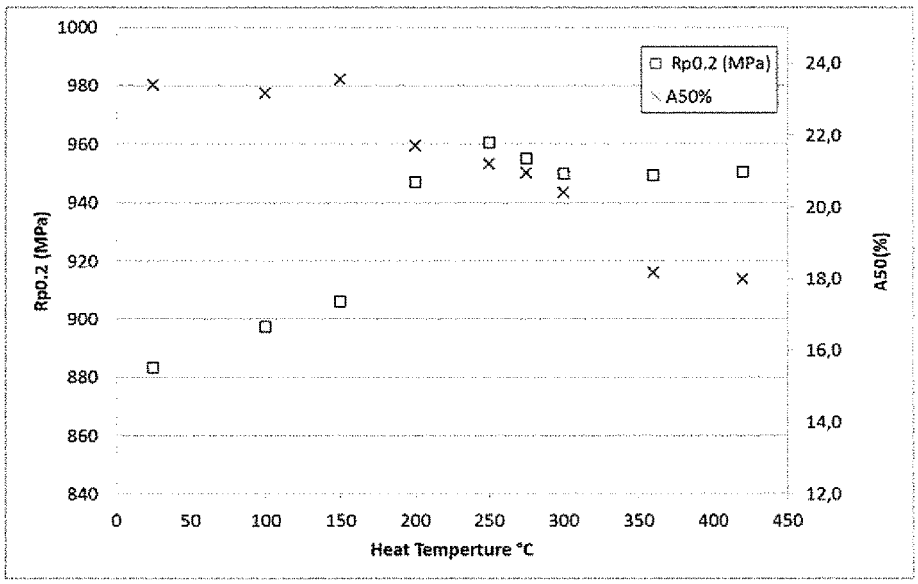
FIG. 4 illustrates the influence of a 10 minute heat treatment at different temperatures on the yield strength ($R_{p0,2}$) and elongation ($A_{50}$).

The material tested in table 4 is the alloy B with a 10% rolling reduction from the table 1 and with the heat treatment period of 10 minutes. The original material corresponds to the room temperature (25° C.) sample in the table 4. The results in the table 4 and in FIG. 4 demonstrate that heating for 10 minutes gives an increase in the strength. In particular, the yield strength ($R_{p0,2}$) is improved reaching a maximum increase by approximately 10% at the temperature 250° C. The elongation ($A_{50}$) is fairly stable up until the temperature 250° C. at 20%. Above this temperature 250° C. the elongation decreases but still remains above 15%. Therefore, short heat treatments within the temperature range 175° C. to 420° C. are shown to improve the yield strength ($R_{p0,2}$) and whilst maintaining good ductility.

The duplex stainless steels temper rolled in accordance with the invention can be used for replacing the temper rolled standard austenitic stainless steels 1.4307 (304L) and 1.4404 (316L) in applications where a need for better general corrosion resistance, erosion and fatigue problems exist as well as in applications where these austenitic stainless steels are not able to reach a desired strength/ductility ratio. Possible applications of use can be for instance machinery components, building elements, conveyor belts, electronic components, energy absorption components, equipment casings and housings, flexible lines (carcass and armouring wire), furniture, lightweight car and truck components, safety midsole, structural train components, tool parts and wear parts.

The invention claimed is:

1. A method for producing a high-strength ferritic austenitic duplex stainless steel with the TRIP (Transformation induced plasticity) effect with deformation, comprising:

heat treating the ferritic austenitic duplex stainless steel in a temperature range of 950-1150° C. in order to have high tensile strength level of at least 1000 MPa with retained formability;

deforming the ferritic austenitic duplex stainless steel with a reduction degree of at least 20%;

heating the ferritic austenitic duplex stainless steel from room temperature 25° C. to 250° C. so the yield strength of the stainless steel reaches a maximum increase by approximately 10% and the elongation remains above 15%;

wherein the ratio $R_{d50\ \%}$(TR %)/$R_{d50\ \%}$(0%) is more than 1.2;

wherein the deforming of the ferritic austenitic duplex stainless steel comprises temper rolling, and wherein $R_{d50\ \%}$(TR %) is the fatigue limit of the ferritic austenitic duplex stainless steel after the temper rolling, and $R_{d50\ \%}$(0%) is the fatigue limit of the ferritic austenitic duplex stainless steel before the temper rolling.

2. The method according to the claim 1, wherein at a reduction degree of 40%, a tensile strength level of at least 1300 MPa is achieved.

3. The method according to claim 1, wherein a mean volumetric wear rate for erosion resistance after deforming is below 6.0 $mm^3$/kg.

4. The method according to claim 1, wherein the deforming of the ferritic austenitic duplex stainless steel comprises tension levelling.

5. The method according to claim 1, wherein the deforming of the ferritic austenitic duplex stainless steel comprises roller levelling.

6. The method according to claim 1, wherein the deforming of the ferritic austenitic duplex stainless steel comprises drawing.

7. The method according to claim 1, wherein the ferritic austenitic duplex stainless steel contains in weight % greater than 0% and less than 0.05% carbon (C), 0.2-0.7% silicon (Si), 2-5% manganese (Mn), 19-20.5% chromium (Cr), 0.8-1.5% nickel (Ni), greater than 0% and less than 0.6% molybdenum (Mo), greater than 0% and less than 1% copper (Cu), 0.16-0.26% nitrogen (N), the sum C+N being 0.2-0.29%, greater than O weight % and less than 0.010 weight % S, greater than 0 weight % and less than 0.040 weight % P so that the sum (S+P) is less than 0.04 weight %, and the total oxygen (O) above O ppm and below 100 ppm, optionally contains one or more added elements: 0-0.5% tungsten (W), 0-0.2% niobium (Nb), 0-0.1% titanium (Ti), 0-0.2% vanadium (V), 0-0.5% cobalt (Co), 0-50 ppm boron (B), and 0-0.04% aluminium (Al); the balance being iron (Fe) and inevitable impurities.

8. The method according to claim 1, wherein the ferritic austenitic duplex stainless steel contains in weight % greater than 0% and less than 0.05% carbon (C), 0.2-0.7% silicon (Si), 2-5% manganese (Mn), 19-20.5% chromium (Cr), 0.8-1.5% nickel (Ni), greater than 0% and less than 0.6% molybdenum (Mo), greater than 0% and less than 1% copper (Cu), 0.16-0.26% nitrogen (N), optionally contains one or more added elements: 0-0.5% tungsten (W), 0-0.2% niobium (Nb), 0-0.1% titanium (Ti), 0-0.2% vanadium (V), 0-0.5% cobalt (Co), 0-50 ppm boron (B), and 0-0.04% aluminium (Al); the balance being iron (Fe) and inevitable impurities.

* * * * *